US005608494A

United States Patent [19]

Ogura et al.

[11] Patent Number: 5,608,494

[45] Date of Patent: Mar. 4, 1997

[54] IMAGE FORMING APPARATUS USING ID CARD HAVING COUNTER

[75] Inventors: Masahiko Ogura, Yokohama; Masashi Honda, Kamakura, both of Japan

[73] Assignee: Kabushiki Kaisha Toshiba, Kawasaki, Japan

[21] Appl. No.: 361,856

[22] Filed: Dec. 22, 1994

Related U.S. Application Data

[63] Continuation of Ser. No. 34,115, Mar. 22, 1993, abandoned.

[30] Foreign Application Priority Data

Sep. 24, 1992 [JP] Japan ..... 4-254519

[51] Int. Cl.[6] ..... G03G 21/02

[52] U.S. Cl. ..... 399/366; 377/13; 399/80

[58] Field of Search ..... 355/201, 204, 355/308, 311; 377/13, 15, 16

[56] References Cited

U.S. PATENT DOCUMENTS

| | | | |
|---|---|---|---|
| 4,501,485 | 2/1985 | Tsudaka | 355/201 |
| 5,030,990 | 7/1991 | Iwaki et al. | 355/204 |
| 5,043,762 | 8/1991 | Iwaki et al. | 355/204 |
| 5,117,258 | 5/1992 | Iwata | 355/201 |
| 5,212,519 | 5/1993 | Kasahara et al. | 355/201 X |
| 5,260,742 | 11/1993 | Kikkawa | 355/204 X |
| 5,270,775 | 12/1993 | Suzuki | 355/204 |
| 5,300,761 | 4/1994 | Kasahara et al. | 355/201 |

FOREIGN PATENT DOCUMENTS

| | | |
|---|---|---|
| 57-23961 | 2/1982 | Japan . |
| 61-277976 | 12/1986 | Japan . |

OTHER PUBLICATIONS

Japanese Patent Abstract of vol. 10, No. 375 (P–493) (2312), Sep. 2, 1986 and JP–A–61 083 552 (Mitsubishi), Apr. 28, 1986.

Japanese Patent Abstract of vol. 13, No. 375 (P–921), Aug. 21, 1989 and JP–A–01 130 168 (Sanyo), May 23, 1989.

Japanese Patent Abstract of vol. 10, No. 256 (P–493) (2312), Sep. 2, 1986 and JP–A–61 084 659 (Mitsubishi), Apr. 30, 1986.

*Primary Examiner*—Nestor R. Ramirez
*Attorney, Agent, or Firm*—Limbach & Limbach

[57] ABSTRACT

An image forming apparatus for totalizing data obtained at the time of operation, such as the number of copying operations performed for each user, by using a single portable medium is disclosed. The image forming apparatus includes a first memory for storing identification information which identifies operators who are permitted to use the apparatus. Data which is entered by the user is compared with the stored data in order to verify if the user is in fact authorized to use the apparatus. Additional data, such as the number of copies made, is stored corresponding to each user. Additional categories for which data may be collected and stored are disclosed including the time frame, the particular machine, and the size of the paper being used.

5 Claims, 12 Drawing Sheets

IMAGE FORMING APPARATUS USING ID CARD HAVING COUNTER

This is a continuation of application Ser. No. 08/034,115 filed on Mar. 22, 1993, now abandoned.

BACKGROUND OF THE INVENTION

1. Field of the Invention

This invention relates to an image forming apparatus such as an electronic copying machine capable of preventing unauthorized copying (unauthorized use) and totalizing the number of copied sheets for each user, for example.

2. Description of the Related Art

Conventionally, a key counter is used or an ID code (personal identification information) is registered as a means for monitoring the number of copied sheets and preventing the unauthorized copying. The key counter permits the copying machine to be set into the operative state when it is attached to the copying machine and it counts the number of copied sheets (the number of image forming operations). In the ID code registration method, the copying machine is set into the operative state when the user inputs the previously registered ID code by means of the operation panel and the number of copied sheets (the number of image forming operations) is counted for each ID code.

However, when the number of copied sheets is monitored and totalized for each user by use of the key counter, a key counter must be prepared and monitored for each user. In this case, it is difficult to totalize the number of copied sheets for each relatively short period of time, for example, for each day or for each month.

In the ID code registration method, the number of copied sheets can be monitored and totalized for each day for each user. In this case, since a key is not used, even an unauthorized person can use the copying machine if a registered ID code is input via the operation panel, and this is not preferable from the viewpoint of the operation of monitoring and totalizing the number of copied sheets.

Further, the number of copied sheets cannot be totalized for each paper size.

The technique of using a card with the ID function and counting the number of copied sheets for each card (for each ID card) or counting the number of copied sheets for each paper size is known as the technique using a card. However, the technique is based on a reading system for magnetically or optically reading the signal inherent to the card by the copying machine body or an exclusive device connected to the copying machine and the counts of the respective numbers of copied sheets are stored into the copying machine body or the exclusive device connected to the copying machine. Therefore, when the counts of the respective numbers of copied sheets are totalized by use of a personal computer, for example, the personal computer must be connected to the copying machine to transfer the count data from the copying machine to the personal computer.

SUMMARY OF THE INVENTION

An object of this invention is to provide an image forming apparatus capable of totalizing the number of image forming operations for each copy paper size for each user and minutely monitoring the number of image forming operations by using a single portable type medium.

The above object can be attained by an image forming apparatus of the present invention. The apparatus includes: first memory means for storing a first data which identifies an operator who is permitted to use the image forming apparatus; means for inputting a second data by an operator; means for verifying the second data inputted by the inputting means with the first data stored in the storing means; means for forming an image under a predetermined image forming condition when the verifying means verifies that the second data corresponds to the first data stored in the first storing means; and second memory means for storing third data indicating the predetermined image forming condition corresponding to the first data, after a completion of an image forming operation by the forming means.

In this invention with the above construction, since it is required to input an adequate ID code by use of the portable type medium, it becomes possible to prevent a person other than the authorized users from using the image forming apparatus. Further, it is possible to count the predetermined image forming condition data obtained at the time of operation for each user by use of one of the second memory means which corresponds to the input ID code. The condition data obtained at the time of operation is information indicating the user who has operated the image forming apparatus, day and month on which the copying operation is effected, the number of times of the copying operations, the size of the copied paper, and the like, for example. As a result, precise information of usage for each user can be collected. Further, in this invention, since counters are provided in the portable type medium, the condition data items can be easily totalized by directly connecting the portable type medium to a personal computer or the like, and it is not necessary to connect the medium to the main body of the image forming apparatus unlike the conventional case.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

There will now be described an embodiment of this invention with reference to the accompanying drawings.

First, the first embodiment is explained.

Figure 2:
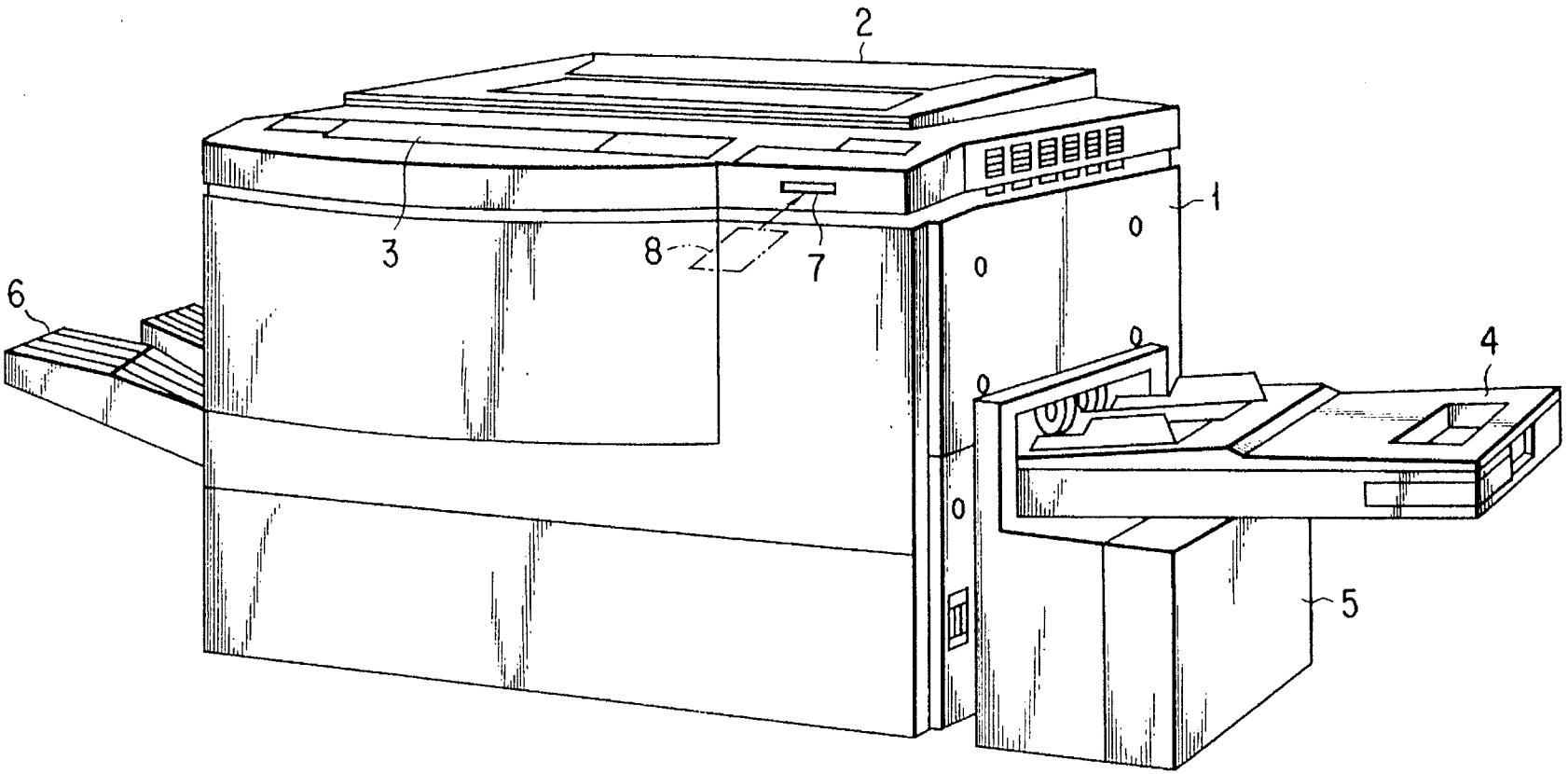
FIG. 2 is a perspective view of the external appearance of the electronic copying machine according to the embodiment of this invention.

FIG. 2 shows the external appearance of an electronic copying machine as an example of an image forming apparatus according to this invention. In FIG. 2, an original table (not shown) is mounted on a copying machine body 1 and an original cover 2 which can be moved to cover the original is movably mounted on the original table. An operation panel 3 having various operation keys and a display is mounted on the front upper portion of the main body 1 and the user uses the operation panel 3 to input and set various data and input a copying operation starting command.

A paper supply cassette 4 of small capacity and a paper supply cassette 5 of large capacity are removably mounted on the right side portion of the main body 1 in the drawing. A paper discharging tray 6 for discharging copied paper is mounted on the left side portion of the main body 1 in the drawing.

A card attachment section (which is constructed by a card insertion slot, connector and the like) 7 is mounted on the front upper portion of the main body 1 and a memory card 8 used as a portable type medium is removably inserted into the card attachment section 7.

Figure 3:
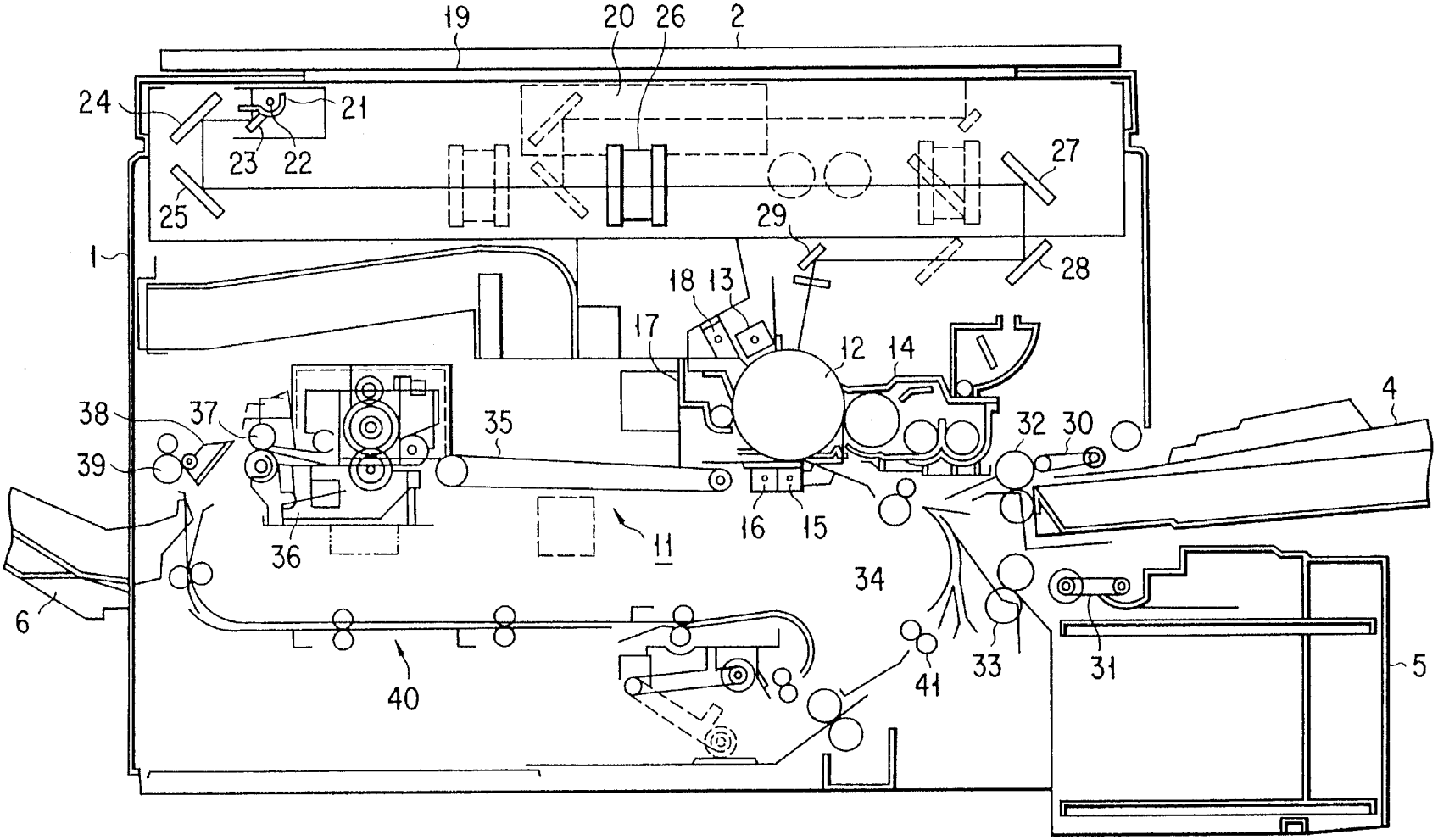
FIG. 3 is a side view schematically showing the internal structure of the electronic copying machine according to the embodiment of this invention.

FIG. 3 schematically shows the internal structure of the above electronic copying machine. In FIG. 3, an image forming means 11 for forming an image by effecting the image forming processes including the charging, discharging, developing, fixing and clearing processes is provided in the main body 1. The image forming means 11 has a photosensitive drum 12 serving as an image carrier which is rotatably mounted on substantially the central portion in the main body 1, and a charging device 13, a magnetic brush type developing device 14 using two-component developer containing toners and carriers, an image transferring device 15, a separation device 16, cleaning device 17 and a discharging device 18 are arranged in this order along the peripheral portion of the photosensitive drum 12. The photosensitive drum 12 rotates in a clockwise direction to have the surface thereof uniformly charged by the charging device 13.

An original table 19 formed of a transparent glass plate is disposed on the top surface of the main body 1 and an original cover 1 for holding the original (not shown) is movably mounted on the original table 19 so as to be freely set into an open/closed position.

An exposing device 20 serving as an exposing means is disposed below the original table 19. The exposing device 20 has an optical system which includes an exposing lamp 22 having a reflector 21 disposed to surround the rear portion thereof, first, second and third mirrors 23, 24 and 25, a lens 26 and fourth, fifth and sixth reflection mirrors 27, 28 and 29.

The image of the original (not shown) set on the original table 19 is optically scanned by the exposing device 20 and exposed to the photosensitive drum 12 of the image forming means 11 so as to form an electrostatic latent image on the photosensitive drum 12.

The electrostatic latent image formed on the photosensitive drum 12 is developed into a toner image by toners serving as developing powder supplied from the developing device 14 and held in the magnetic brush.

A paper supply cassette 4 of small capacity for receiving sheets of paper and a paper supply cassette 5 of large capacity are removably mounted on the right portion of the main body 1 in the drawing. Sheets of paper can be selectively derived out one by one from the paper supply cassette 4 or 5 via pick-up rollers 30, 31 and paper supply rollers 32, 33.

Paper derived out from one of the paper supply cassettes 4 and 5 is guided and fed into between the photosensitive drum 12 and the transfer device 15 which is disposed opposite to the photosensitive drum 12 by means of paired resist rollers 34 and the toner image on the photosensitive drum 12 is transferred onto the paper by the transfer device 15.

The paper having been subjected to the image transferring process is separated from the photosensitive drum 12 by the separation device 16 utilizing the A.C. corona discharging, then fed to the fixing device 36 via the carrying belt 35 and the toner image is fixed on the paper by melting the toners of the toner image by the fixing device 36.

The paper having been subjected to the image fixing process is discharged by means of paired paper drawing rollers 37 disposed on the downstream side of the fixing device 36 and then the paper is discharged to the paper discharging tray 6 disposed outside the main body 1 or fed back to an inverting means 40 arranged in the bottom portion of the main body 1 according to the switching position of a gate 38 disposed on the downstream side of the paired paper drawing rollers 37.

The paper fed to the inverting means 40 is switched back and then guided and fed into between the photosensitive drum 12 and the transfer device 15 via the resist roller pairs 41 and 34, thereby making it possible to copy images on both surfaces of the paper.

The remaining toners left behind on the photosensitive drum 12 after the toner image is transferred on the paper and the paper is separated from the photosensitive drum are scraped off by the cleaning device 17 and the used toners thus scraped off and waste toners containing foreign matter are discharged to the exterior of the cleaning device 17 via carrying rollers (not shown). The surface of the photosensitive drum 12 cleaned by the cleaning device 17 is electrically discharged by the discharging device 18 so as to set the potential thereof equal to or lower than a preset potential level, thus making ready for the next copying operation.

Figure 1:
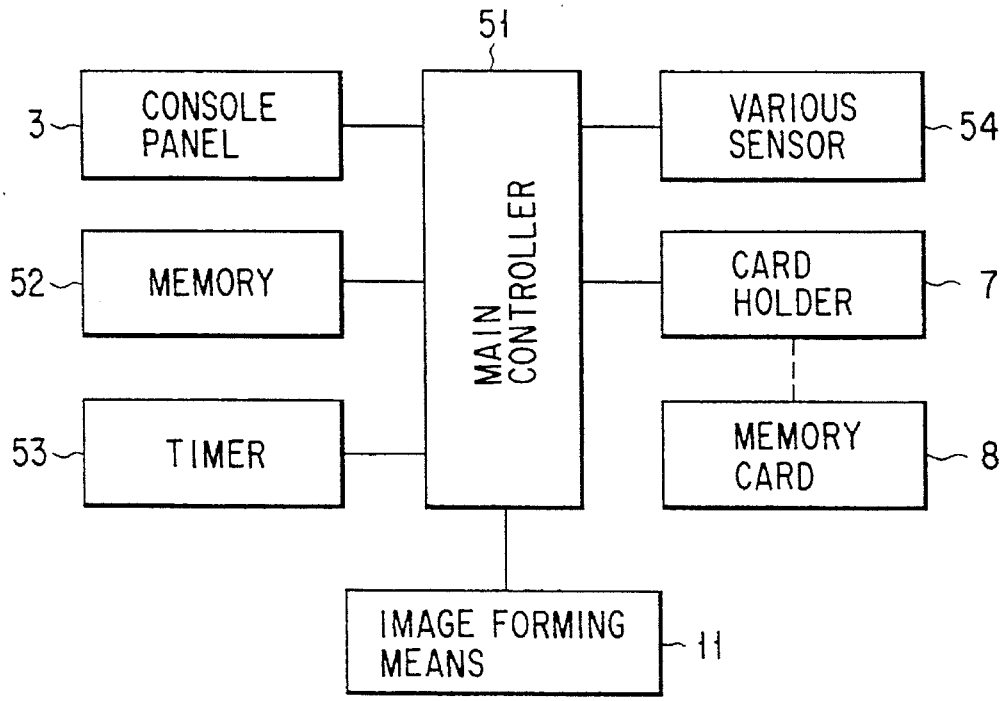
FIG. 1 is a block diagram schematically showing the control system of an electronic copying machine according to one embodiment of this invention.

FIG. 1 schematically shows the control system of the electronic copying machine with the above-described construction. As shown in FIG. 1, the control system includes a control unit 51 which serves as control means for controlling the whole operation of the apparatus and which is mainly constructed by a CPU (central processing unit), for example. The control unit 51 is connected to the operation panel (console panel) 3, card attachment section (card holder) 7, image forming means 11, data storing memory (memory) 52, timer 53 for generating calendar information (such as hour information and date information), and various sensors 54 (which are not shown individually).

Figure 4:
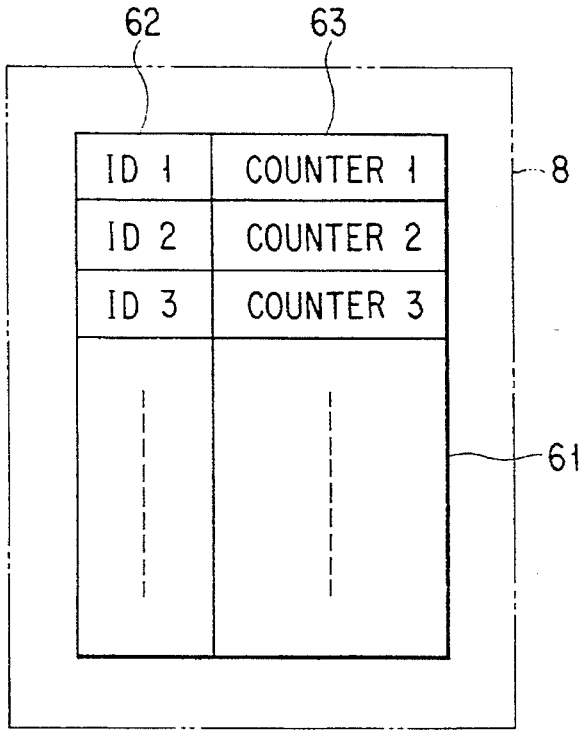
FIG. 4 is a construction diagram of a memory card according to a first embodiment.

Now, the memory card 8 is explained in detail with reference to FIG. 4. The memory card 8 has a RAM (random access memory) 61 as storing means disposed therein. The RAM 61 is constructed by an ID storing area 62 in which ID codes (ID1, ID2, ID3, - - - ) used as personal identification information for a plurality of users are previously stored (registered) and a counter area 63 in which counters (counters 1, 2, 3, - - - ) corresponding to the ID codes stored in the ID storing area 62 are assigned as a plurality of counting means for counting the number of sheets of copied paper (the number of image forming operations) and the access control for the areas 62 and 63 is effected by the control unit 51 via the card attachment section 7.

The RAM 61 is backed up by a battery (not shown) set in the memory card 8 so that the stored data can be held even after the memory card 8 is removed from the card attachment section 7.

Data in the RAM 61 can be written in or read out by the operator by inserting the memory card 8 into the card attachment section 7 and setting the ID registration mode by use of the operation panel 3.

The ID registration mode is set by a procedure which is not usually effected by the user, for example, by turning on the power source switch while simultaneously depressing the copy starting key and the "8" key in the ten keys provided on the operation panel so as to prevent the user from unwantedly rewrite the data. In the ID registration, the operator can read out, rewrite, add and delete the counter data or ID code in the memory card 8 by use of the operation panel 3.

Further, since data of the memory card 8 can be generally read out or written by use of an electronic device such as an electronic notebook or personal computer, the counter data or ID code can be read out, rewritten, added and deleted by an electronic device other than the copying machine.

Figure 5:
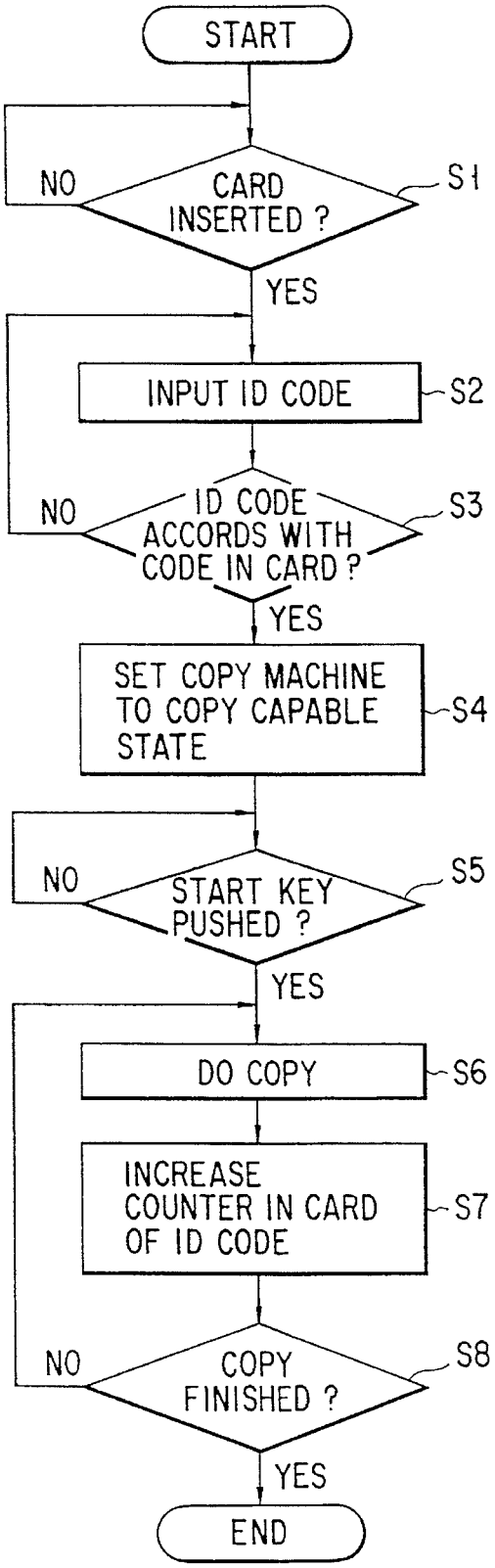
FIG. 5 is a flowchart for illustrating the operation of the first embodiment.

The operation of the device with the above construction is explained with reference to the flowchart shown in FIG. 5. First, the user inserts the memory card 8 which he has into the card attachment section 7 (S1) and inputs a previously given ID code (for example, a 4-digit number) by use of the ten keys of the operation panel 3 (S2). The control unit 51 collates the input ID code with the ID codes in the RAM 61 of the memory card 8 to check whether or not the input ID code coincides with one of the ID codes in the memory card 8 (S3).

In a case where it is detected that an ID code which coincides with the input ID code is stored in the memory card 8 as the result of checking process, the control unit 51 sets the operation mode into the copy permitting state (S4). In a case where an ID code coinciding with the input ID code does not lie in the memory card, the control unit 51 displays information that an ID code should be input again on the display unit of the operation panel 3.

If the user depresses the copy starting key of the operation panel after the apparatus is set into the copy permitting state (S5), the control unit 51 effects the preset copying operation (S6). At this time, the control unit 51 increments the content of the counter corresponding to the ID code which coincides with the input ID code in the RAM 61 of the memory card 8 inserted into the card attachment section 7 by one count each time the copying operation is effected for one sheet of paper (S7).

In this case, it is possible to add the number corresponding to the number of sheets of copied paper to the content of the counter after the preset number of sheets of paper have been copied instead of incrementing the content of the counter by one count each time the copying operation is effected for one sheet of paper.

Next, the control unit 51 checks whether the process of copying a preset number of sheets of paper is completed or not (S8), effects the same operation as the operation from the step S6 if the copying process is not yet completed and stops the copying operation if the copying process is completed.

As described above, according to the first embodiment, the features of the conventional methods using the key counter and the ID code can be obtained and the number of sheets of copied paper can be totalized for each user and can be more minutely controlled simply by using a single memory card.

Further, since the copy permitting state cannot be set up if the memory card is not attached to the copying machine, an unauthorized copying operation can be prevented.

Further, since data indicating the counted number of sheets of copied paper is stored in the memory card which can be removably attached to the copying machine, data items can be totalized by use of a personal computer or the like and data can be easily processed.

Next, a second embodiment is explained.

Figure 6:
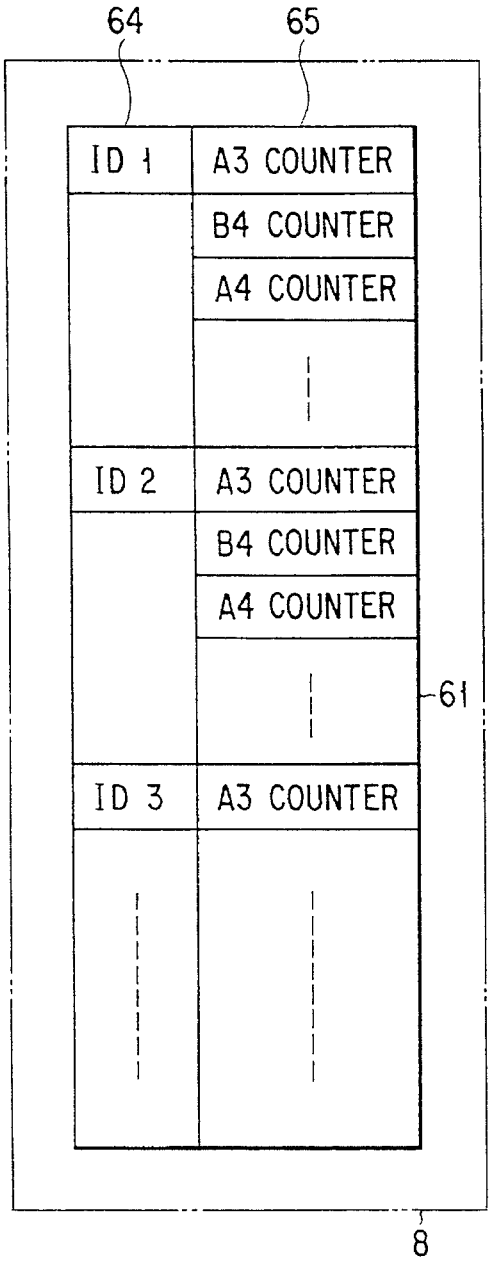
FIG. 6 is a construction diagram of a memory card according to a second embodiment.

The second embodiment is so designed that the number of sheets of copied paper can be counted for respective paper sizes selected by the user and the second embodiment is explained in detail below. FIG. 6 shows the construction of a memory card 8. In the case of this embodiment, a RAM 61 is constructed by an ID storing area 64 in which ID codes (ID1, ID2, ID3, - - - ) of a plurality of users are previously stored and a counter area 65 in which a plurality of counters (A3 counter, B4 counter, A4 counter, - - - ) provided for counting the number of sheets of copied paper for respective paper sizes and corresponding to the ID codes stored in the ID storing area 64 are assigned and the access control for the areas 64 and 65 is effected by the control unit 51 via the card attachment section 7.

Figure 7:
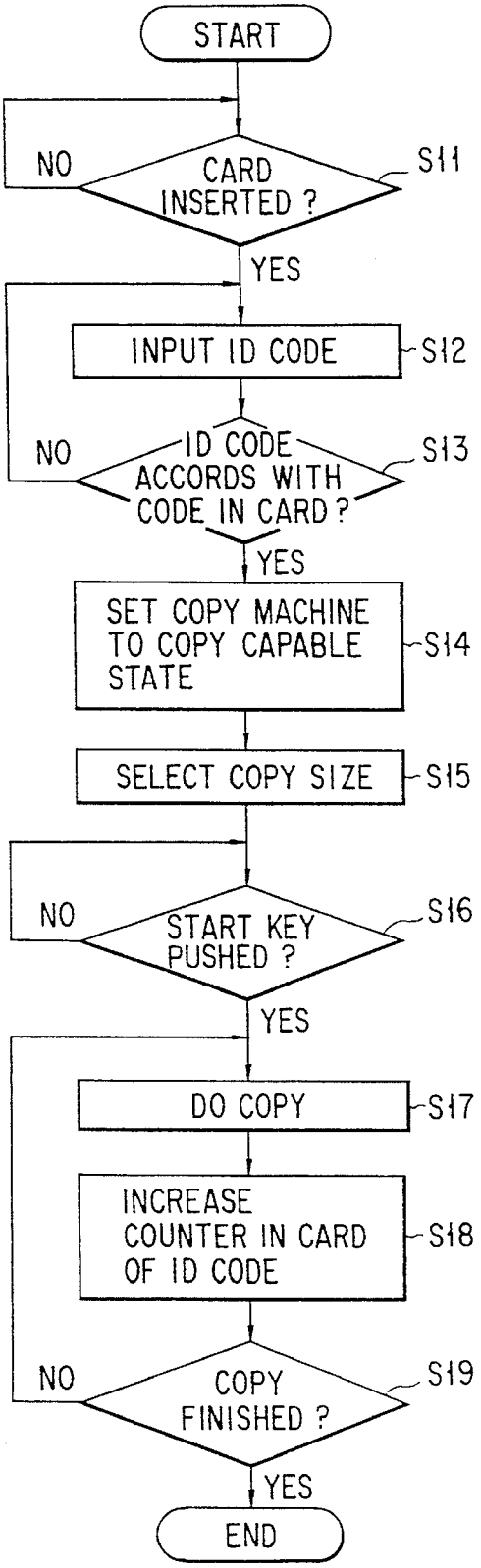
FIG. 7 is a flowchart for illustrating the operation of the second embodiment.

The operation of the apparatus with the above construction is explained with reference to the flowchart shown in FIG. 7. The copy permitting state can be set up by effecting steps S11 to S14 which are the same as the steps S1 to S4 in the first embodiment.

If the user selects the size of paper to be copied by use of the operation panel 3 (S15) and depresses the copy starting key of the operation panel (S16) after the apparatus is set into the copy permitting state, the control unit 51 effects the preset copying operation for the paper of the selected size (S17).

At this time, the control unit 51 detects the selected paper size and increments the content of the counter corresponding to the selected paper size and the ID code which coincides with the input ID code in the RAM 61 of the memory card 8 inserted into the card attachment section 7 by one count each time the copying operation is effected for one sheet of paper.

Next, the control unit 51 checks whether the process of copying a preset number of sheets of paper is completed or not (S19), effects the same operation as the operation from the step S17 if the copying process is not yet completed and stops the copying operation if the copying process is completed.

As described above, according to the second embodiment, the features of the conventional methods using the key counter and the ID code can be obtained and the number of sheets of copied paper can be totalized for the respective paper sizes for each user and can be more minutely controlled simply by using a single memory card.

Figure 8:
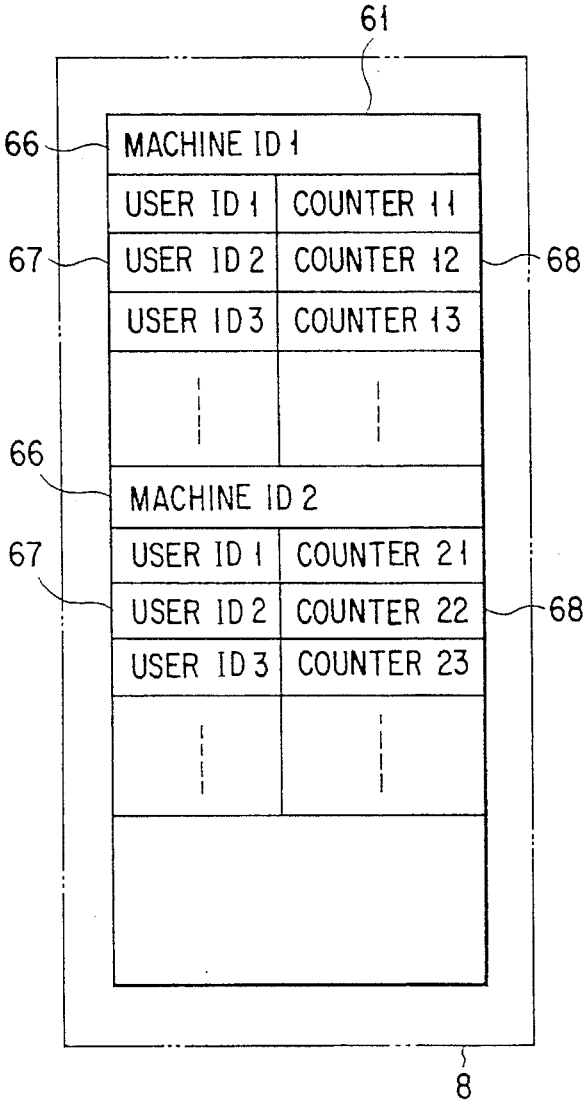
FIGS. 8 to 15 are construction diagrams according to other embodiments.

The third embodiment is so designed that the numbers of sheets of copied paper can be counted for respective copying machines and is explained in detail below. FIG. 8 shows the construction of a memory card 8. In the case of this embodiment, a RAM 61 includes a machine ID storing area 66 in which ID codes (machine ID codes ID1, ID2, ID3, - - - ) are previously stored as machine identification information items of a plurality of copying machines, a user ID storing area 67 in which ID codes (user ID codes ID1, ID2, ID3, - - - ) of a plurality of users corresponding to the machine ID codes stored in the machine ID storing area 66 are previously stored, and a counter area 68 in which a plurality of counters (counters 11, 12, 13, - - - , 21, 22, 23, - - - ) corresponding to the respective user ID codes stored in the user ID storing area 67 are assigned for respectively counting the numbers of sheets of copied paper. The access control for the areas 66, 67 and 68 is effected by the control unit 51 via the card attachment section 7.

Further, in the case of this embodiment, a machine ID code serving as machine identification information inherent to the copying machine is previously stored in the memory 52.

The operation of the apparatus with the above construction is explained. The copy permitting state is set up by effecting the process which is the same as the process from the step S1 to the step S4 in the first embodiment. If the user depresses the copy starting key in the operation panel after the copy permitting state is set up, the control unit 51 effects the preset copying operation.

At this time, the control unit 51 increments the content of that one of the counters in the RAM 61 of the memory card 8 attached to the card attachment section 7 which corresponds to the user ID code coinciding with the input ID code and which corresponds to the machine ID code coinciding with the machine ID code stored in the memory 52 by one count each time the copying operation is effected for one sheet of paper. The control unit 51 stops the copying operation if the process of copying a specified number of sheets of paper is completed.

Thus, according to the third embodiment, the features of the conventional methods using the key counter and the ID code can be obtained and the number of sheets of copied paper can be totalized for each user and for each copying machine and can be more minutely controlled simply by using a single memory card.

Figure 9:
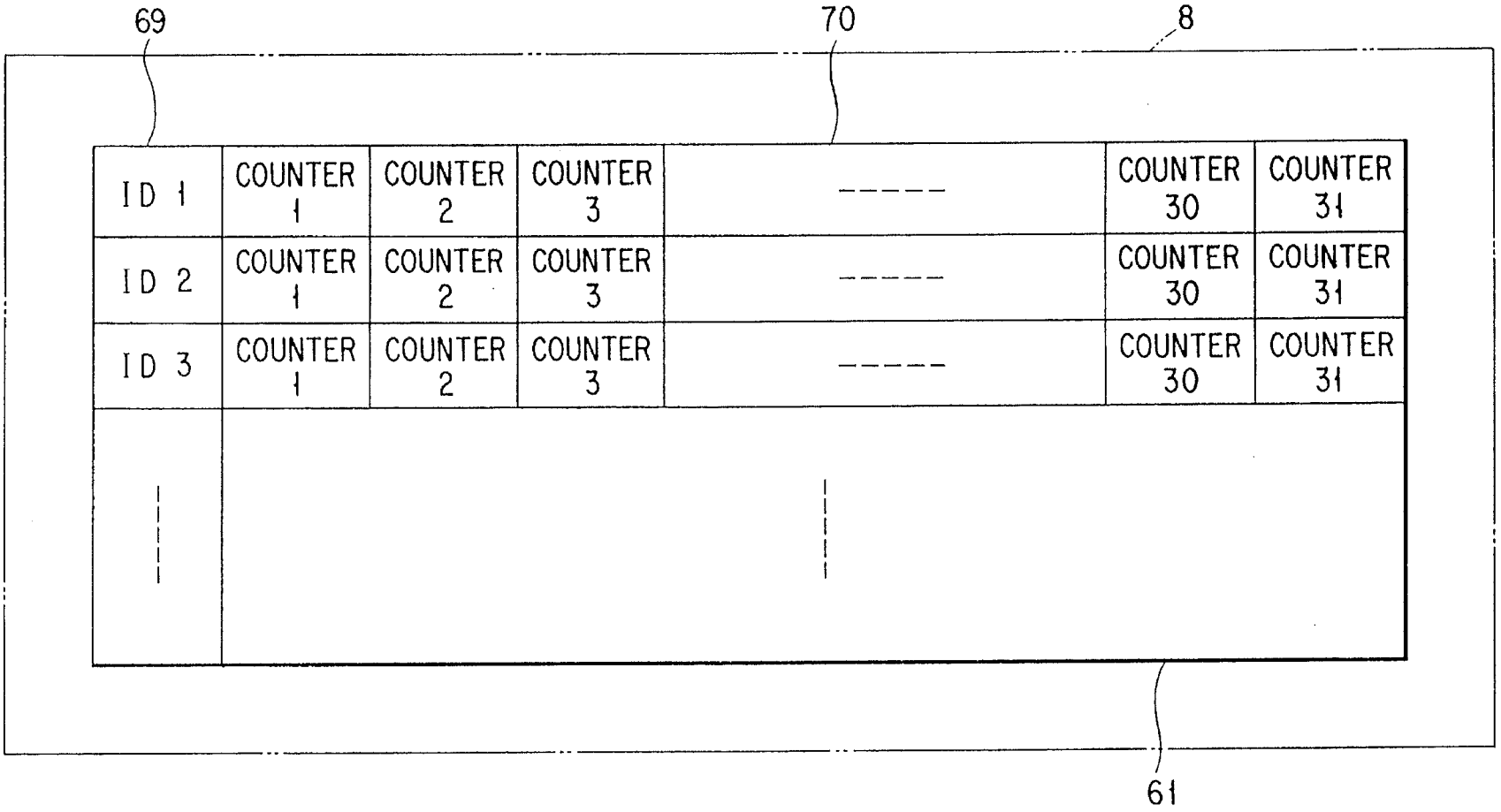

The fourth embodiment is so designed that the numbers of sheets of copied paper can be counted for each day or for each month and is explained in detail below. FIG. 9 shows the construction of a memory card 8. In the case of this embodiment, a RAM 61 includes an ID storing area 69 in which ID codes (ID1, ID2, ID3, - - - ) of a plurality of users are previously stored, and a counter area 70 in which a plurality of counters (counters 1, 2, 3, - - - , 31) corresponding to the respective ID codes stored in the ID storing area 69 are previously assigned for respectively counting the numbers of sheets of copied paper for respective 31 days (one month), for example. The access control for the areas 69 and 70 is effected by the control unit 51 via the card attachment section 7.

The operation of the apparatus with the above construction is explained. The copy permitting state is set up by effecting the process which is the same as the process from the step S1 to the step S4 in the first embodiment. If the user depresses the copy starting key in the operation panel after the copy permitting state is set up, the control unit 51 effects the preset copying operation.

At this time, the control unit 51 determines the date by referring to the calendar information output from a timer 53 each time the copying operation is effected for one sheet of paper and increments the content of that one of the day counters in the RAM 61 of the memory card 8 attached to the card attachment section 7 which corresponds to the ID code coinciding with the input ID code and which corresponds to the above determined date by one count. The control unit 51 stops the copying operation if the process of copying a specified number of sheets of paper is completed.

Thus, according to the fourth embodiment, the features of the conventional methods using the key counter and the ID code can be obtained and the number of sheets of copied paper can be totalized for each user and for each day or month and can be more minutely controlled simply by using a single memory card.

In a case where the number of sheets of copied paper is counted for each month, twelve counters for counting the numbers of sheets of copied paper for respective 12 months may be assigned in the counter area 70, for example. Further, it is also possible to count the numbers of sheets of copied paper for each hour in addition to or instead of each day or month. The function of the timer 53 may be provided in the memory card 8.

In this case, an embodiment which has the features of all of the above embodiments can be made. That is, time information obtained from the timer function and calendar function, information indicating the number of copying operations, and paper size information can be counted for respective personal ID codes and for respective machine ID codes. Further, data which can be detected when the card is attached and the operation is started, for example, the number of troubles which have occurred or use of a special function such as reduction may be counted if necessary.

Figure 10:
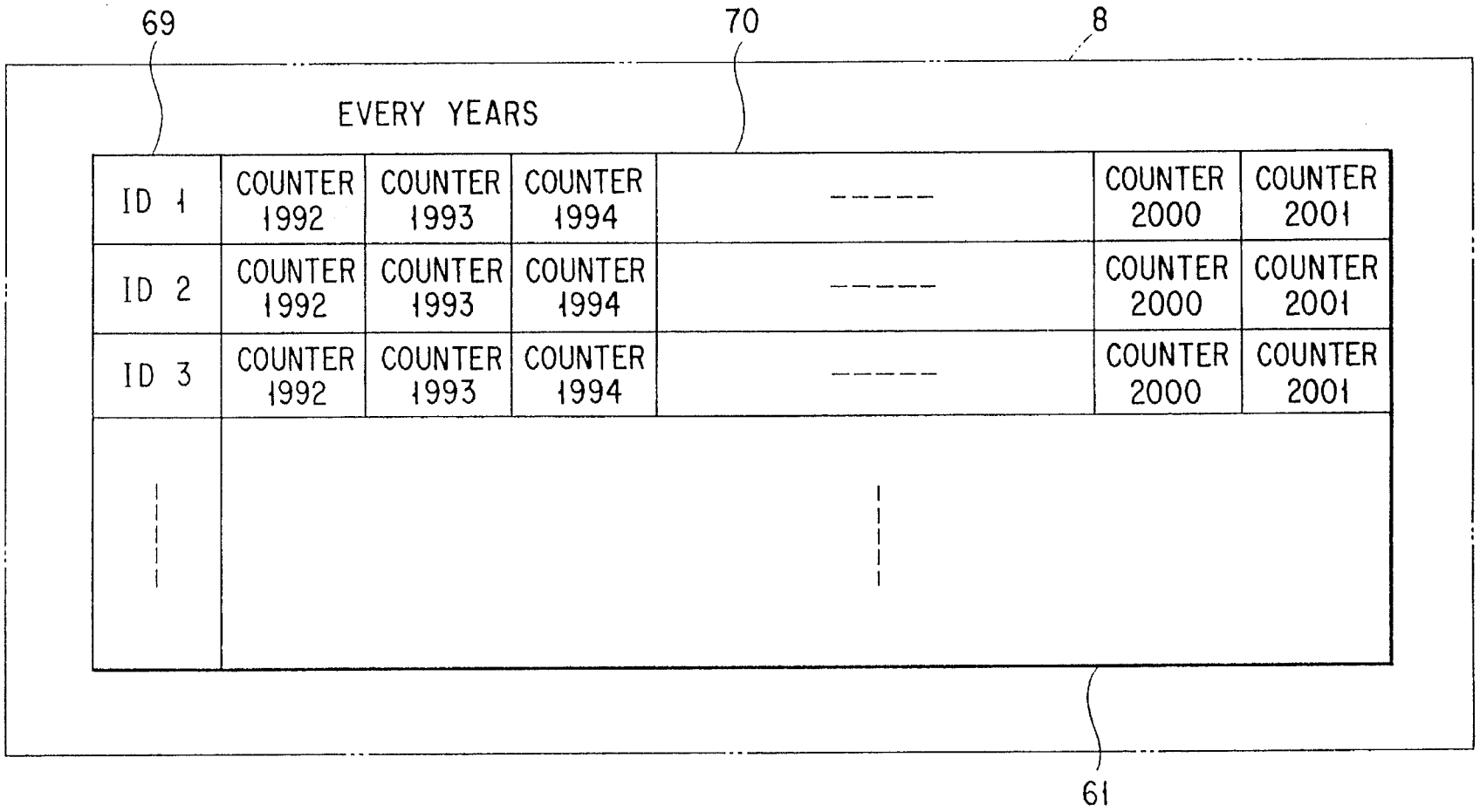
Figure 11:
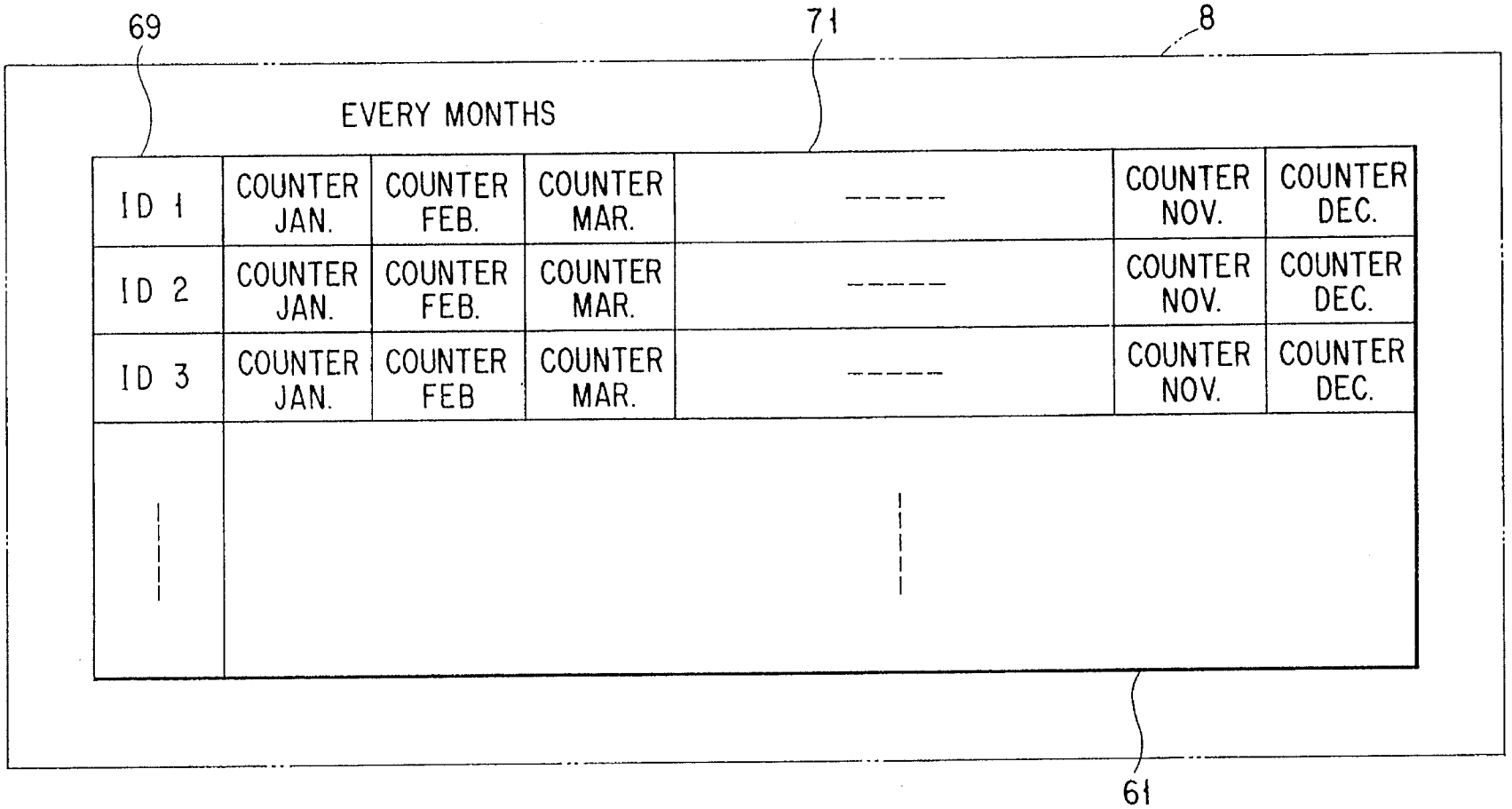
Figure 12:
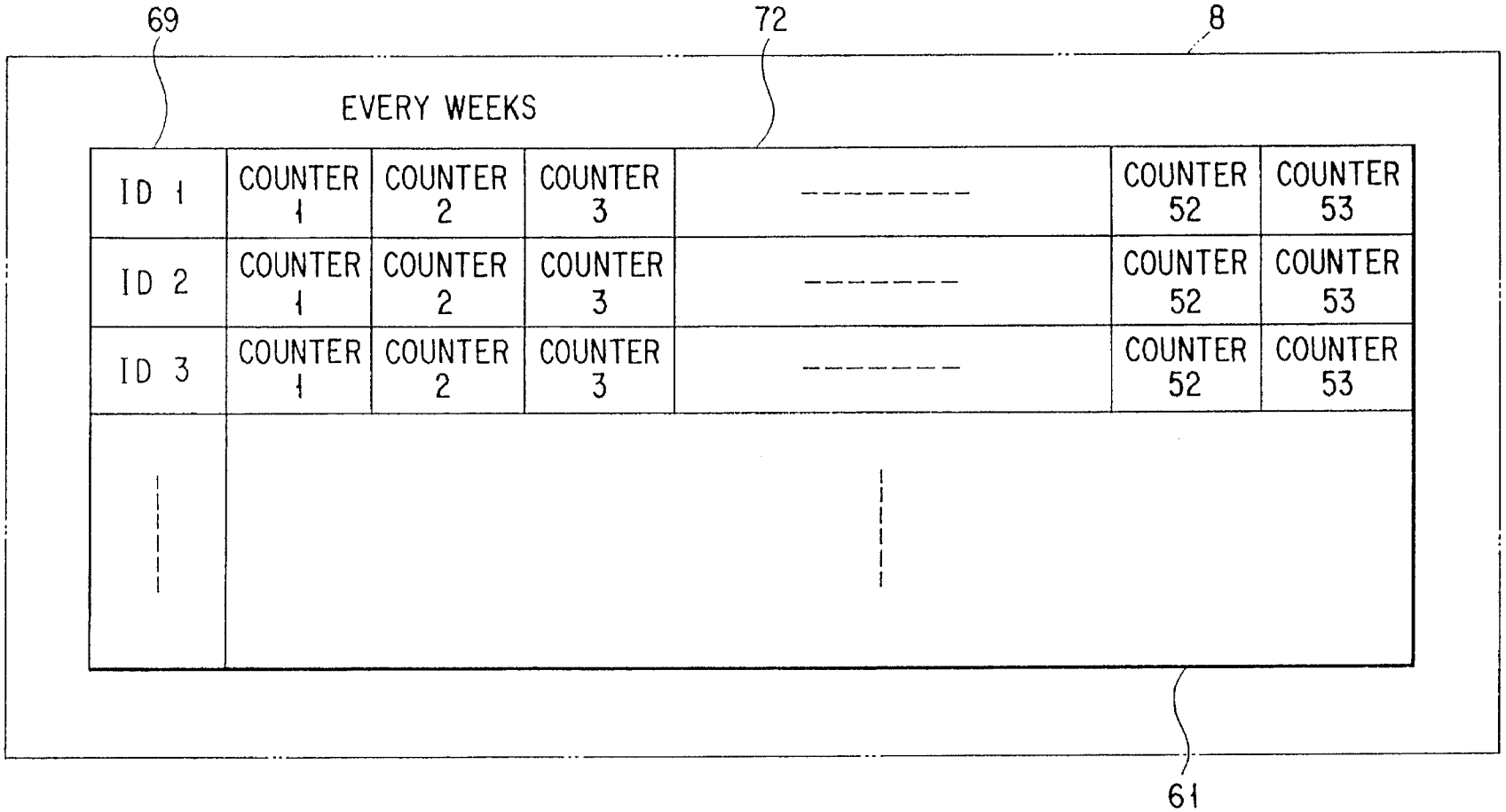
Figure 13:
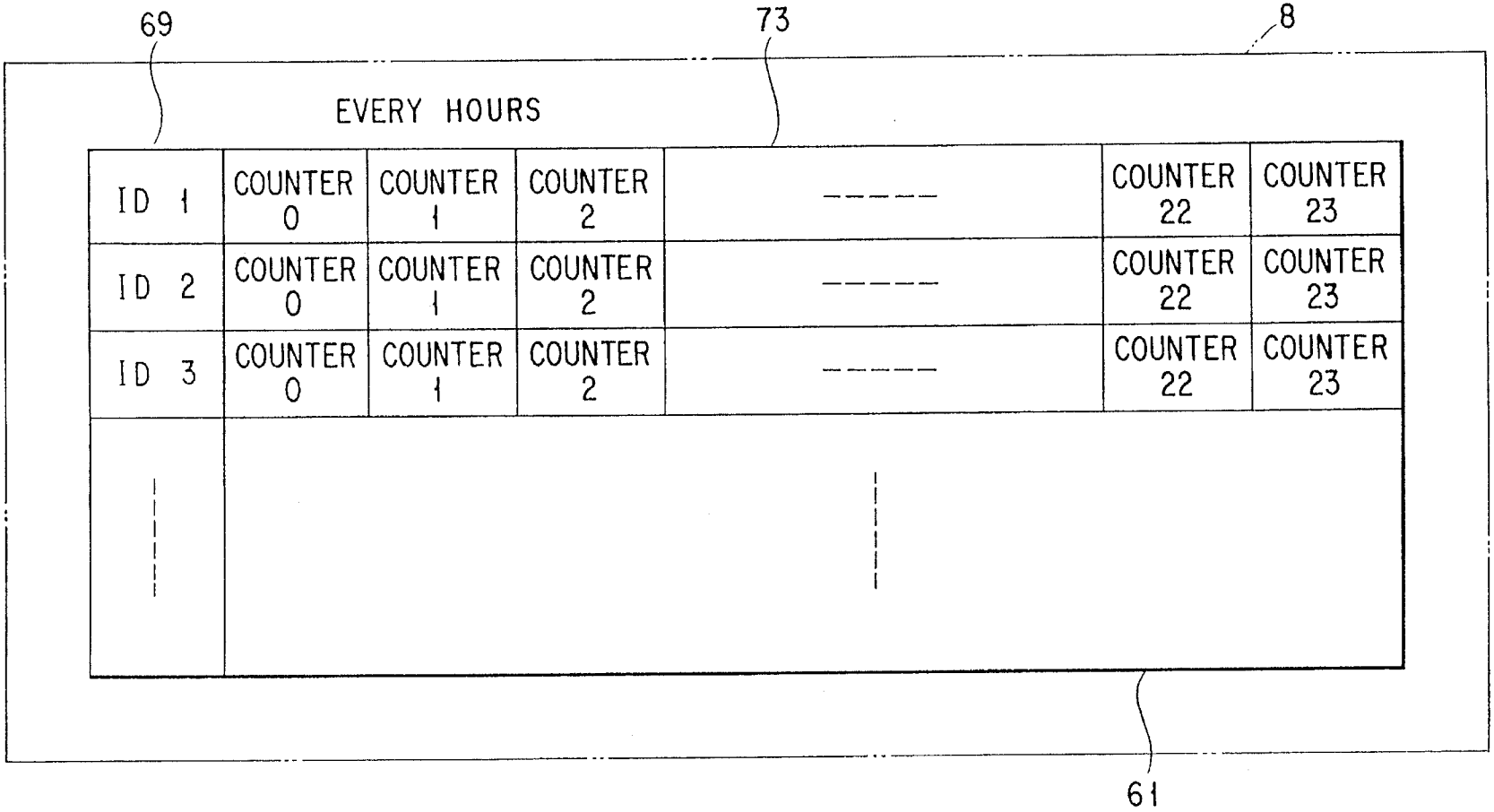
Figure 14:
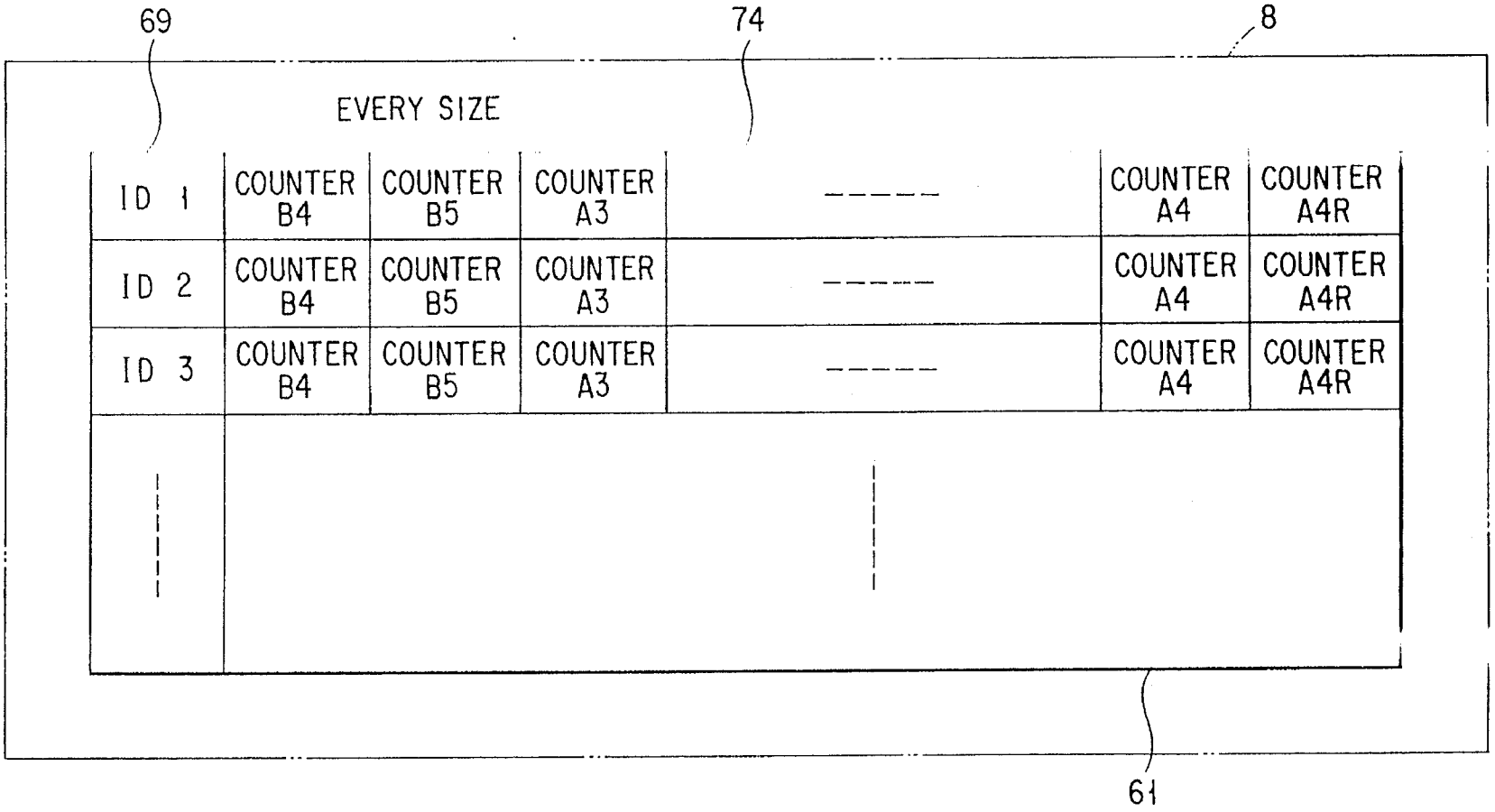
Figure 15:
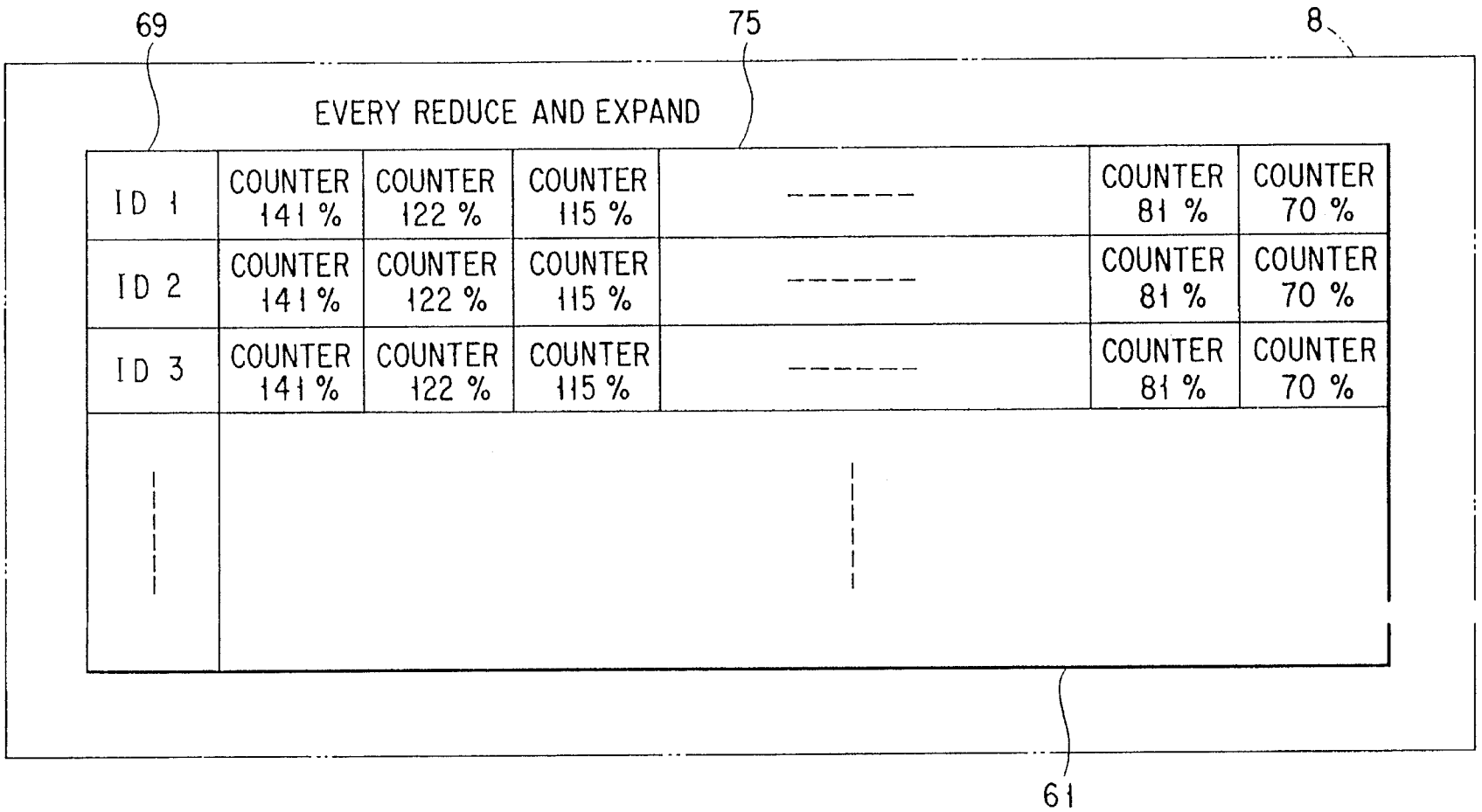

FIGS. 10 to 15 show examples of the construction of a memory card 8 in the above embodiment. In FIG. 10, a RAM 61 includes an ID storing area 69 in which ID codes (ID1, ID2, ID3, - - - ) of a plurality of users are previously stored and counters 70 corresponding to the ID codes stored in the ID storing area 69, for counting the number of sheets of copied paper for each year determined by information obtained from the calendar function. In FIG. 11, counters 71 for counting the number of sheets of copied paper for each month are shown. Likewise, in FIG. 12, counters 72 for counting the number of sheets of copied paper for each week are shown. Likewise, in FIG. 13, counters 73 for counting the numbers of sheets of copied paper for respective hours derived by dividing one day into 24 hours are shown. In FIG. 14, counters 74 for counting the number of sheets of copied paper for each copying paper size are shown, and in FIG. 15, counters 75 for counting the numbers of sheets of copied paper for respective scales of enlargement and reduction are shown.

As described above, according to this invention, an image forming apparatus can be provided in which the number of image forming operations can be totalized for each user, the number of copying operations can be minutely controlled simply by using a single portable type medium and unauthorized use can be prevented.

Further, an image forming apparatus can be provided in which the number of image forming operations can be totalized for each user for respective sizes of media on which an image is formed and the number of copying operations can be more minutely controlled simply by using a single portable type medium.

According to this invention, an image forming apparatus can be provided in which the number of image forming operations can be totalized for each image forming apparatus and for each user and the number of copying operations can be more minutely controlled only by using a single portable type medium.

Further, according to this invention, an image forming apparatus can be provided in which the number of image forming operations can be totalized for each user and for each preset period such as day or month and the number of copying operations can be more minutely controlled simply by using a single portable type medium.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A system for counting a number of paper sheets which are copied on a copy machine, comprising:

(a) a memory card including:

a memory for storing a plurality of first personal identification data, and a plurality of counters for counting the number of paper sheets which are copied, wherein each of the plurality of counters corresponds to a different one of the plurality of first personal identification data; and (b) an image forming apparatus including:

holding means for detachably holding the memory card, inputting means for inputting second personal identification data by an operator desiring to initiate a copying procedure, verifying means for comparing the second personal identification data input by said operator with the plurality of first personal identification data stored in the memory of the memory card to determine which, if any, of the plurality of first personal identification data coincide with the second personal identification data, image forming means for forming an image on a paper sheet, means for permitting the image forming means to form the image on the paper sheet only when the verifying means verifies the coincidence between the second personal identification data input by said operator and said one of the plurality of first personal identification data stored in the memory of the memory card, and means for incrementing a counter of the plurality of counters which corresponds to said one of the plurality of first personal identification data stored in the memory of the memory card, when the image forming means forms the image on the paper sheet.

2. A count system according to claim 1, further comprising:

generating means for generating time data;

counting means for counting how many image forming operations are performed by the image forming means in a predetermined period of time, wherein the predetermined period of time is determined by the time data generated by the generating means; and means for storing a number representing how many of the image forming operations are performed by the image forming means within the predetermined period of time.

3. A count system according to claim 2, further comprising:

judging means for judging a size of paper used in the image forming operation;

means for counting how many image forming operations are performed using the paper whose size was judged by the judging means; and means for storing a number representing how many of the image forming operations correspond to the size of paper judged by the judging means.

4. A method for totalizing a number of sheets copied on a copy machine by each user, comprising the steps of inserting a memory card into the copying machine, the memory card having a storing region for storing a plurality of first personal identification data which identify each of a plurality of users and a counter region provided for storing the number of the sheets copied by each of the users, in accordance with each of the storing data, inputting second personal identification data by a user using an input device attached to the copying machine, comparing the second personal identification data input by the user with the plurality of first personal identification data stored in the memory card inserted in the copying machine, and permitting the copy machine to perform copying operation when the second personal identification data and said one of the plurality of the first personal identification data are identical, and counting the number of sheets copied on the copying machine permitted to perform copying operation in the collating step, and storing the counted number in the counter region which is provided in the memory card in the copy machine, in accordance with the identification data stored in the storing region.

5. A system for counting a number of paper sheets which are copied on a copy machine, comprising:

(a) a memory card having:

a memory device for storing a plurality of first identification data; and a plurality of counters, corresponding to the plurality of first identification data, respectively, for counting and storing the number of paper sheets which are copied by the copy machine (b) an image forming apparatus having:

means for detachably holding the memory card;

means for inputting second identification data by an operator who uses the image forming apparatus;

means for comparing the second identification data input by said operator with the plurality of first identification data stored in the memory device of the memory card to determine which, if any, of the plurality of first personal identification data coincide with the second personal identification data;

means for forming an image on a paper sheet;

means for permitting the image forming means to form the image on the paper sheet only when the verifying means verifies the coincidence with the second identification data input by the operator using the input means and one of the plurality of first identification data stored in the memory device of the memory card, while the holding means being holding the memory card; and means for, every time the image forming means form the image on the paper sheet, incrementing a counter of the plurality of counters which corresponds to said one of the plurality of first identification data, which coincides with the second identification data, if the image forming means is permitted to form the image on the paper sheet;

means for switching the image forming means to a registration mode by a predetermined procedure by a user; and means for reading out, rewriting, adding and deleting the first identification data stored in the memory device and number of paper sheets stored in the counters when the image forming means is in the registration mode.

* * * * *